United States Patent [19]

Bertilsson et al.

[11] 3,938,739

[45] Feb. 17, 1976

[54] NOZZLE FOR ELECTROSTATIC SPRAY GUN

[75] Inventors: Alf Georg Bertilsson, Falkoping; Sten Gunnar Hugo Svensson, Skara, both of Sweden

[73] Assignee: Atlas Copco Aktiebolag, Nacka, Sweden

[22] Filed: Apr. 17, 1974

[21] Appl. No.: 461,588

[30] Foreign Application Priority Data

Apr. 19, 1973 Sweden ..... 7305599

[52] U.S. Cl. ..... 239/15; 118/626

[51] Int. Cl.[2] ..... B05B 5/02

[58] Field of Search ..... 239/3, 15; 118/626

[56] References Cited

UNITED STATES PATENTS

| | | | |
|---|---|---|---|
| 3,072,341 | 1/1963 | Point et al. | 239/15 |
| 3,128,045 | 4/1964 | Gauthier | 239/15 |
| 3,169,883 | 2/1965 | Juvinall | 239/15 X |
| 3,268,171 | 8/1966 | Walberg | 239/3 X |
| 3,290,169 | 12/1966 | Sedlacsik | 239/15 X |
| 3,292,860 | 12/1966 | Williams et al. | 239/3 X |
| 3,317,138 | 5/1967 | Fraser | 239/15 |
| 3,348,186 | 10/1967 | Rosen | 239/15 UX |
| 3,635,401 | 1/1972 | Bromley et al. | 239/15 |
| 3,700,168 | 10/1972 | Ferrant | 239/3 |
| 3,826,425 | 7/1974 | Scharfenberger et al. | 239/15 |

*Primary Examiner*—Robert S. Ward, Jr.
*Attorney, Agent, or Firm*—Flynn & Frishauf

[57] ABSTRACT

An electrostatic spray gun for liquid paint has its nozzle formed in a sintered material that consists of an electrically non-conductive matrix, e.g. polytetrafluoroethylene, with conductive particles, e.g. bronze powder, dispersed in the matrix. The rear end of the nozzle is connected to high voltage, and the annular front surface around the paint discharge orifice in the nozzle is machined so that it shows a lot of such bronze particles that form point electrodes for producing air ions. The paint is dispersed by air jets and the air ions attach to the paint particles.

20 Claims, 3 Drawing Figures

NOZZLE FOR ELECTROSTATIC SPRAY GUN

This invention relates to electrostatic spray guns, and more particularly to an improved nozzle for such spray guns.

BACKGROUND OF THE INVENTION

It has been found that the best way to impart an electrostatic charge to paint is to produce air ions that are intimately mixed with the paint particles that can be either liquid or solid. To this end, needle electrodes connected to a high voltage source have been used in prior art electrostatic spray guns. The best result seems to have been achieved when a sole properly located needle electrode has been used. Alternatively, the paint nozzle itself has been utilized as an electrode in some prior art spray guns. In such a case, the nozzle has been made of a metal and connected to high voltage. This is a more robust construction but it is not as efficient as the ones having needle electrodes. In one prior art spray gun for liquid paint, a sole needle electrode extends axially through the discharge orifice of the nozzle. Although its charging properties are good, the electrode has disadvantages. One major disadvantage is that the paint pattern is seriously biased as soon as the needle is not quite coaxial with the discharge orifice.

It is an object of the invention to provide electrostatic spray guns which efficiently charge the liquid or solid paint particles and which withstand rough handling without their charging efficiency becoming decreased. Another object is to provide a simple and reliable connection of high voltage to the charging electrodes of an electrostatic spray gun.

SUMMARY OF THE INVENTION

In accordance with the present invention, a nozzle for an electrostatic spray gun consists of a non-conductive matrix having electrically conductive particles dispersed therein. An annular surface of the nozzle around the paint discharge orifice includes a plurality of exposed conductive particle surfaces forming a plurality of electrodes for producing air ions. A plurality of the exposed conductive particle surfaces comprise a substantial portion of the maximum cross-section of the respective particle, the exposed particle surfaces being substantially coplanar with the immediately adjacent surface of the non-conductive matrix material.

BRIEF DESCRIPTION OF THE DRAWINGS

The invention is further described with reference to the accompanying drawings in which an electrostatic spray gun intended for liquid paint is shown by way of example. The invention can be applied also to an airless spray gun and to a powder spray gun although such embodiments are not illustrated.

DESCRIPTION OF THE PREFERRED EMBODIMENT

Figures 1, 2, 3:
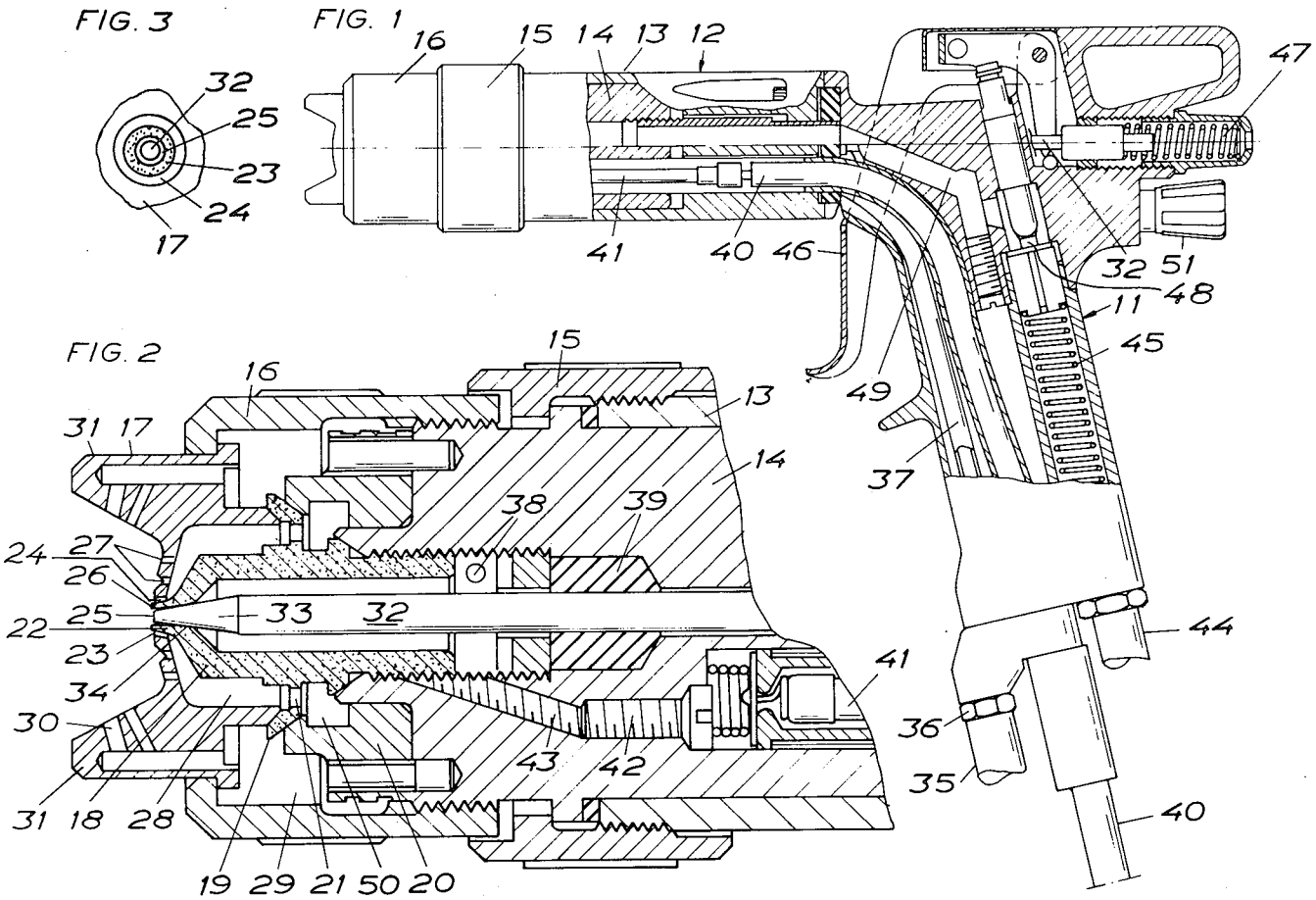
FIG. 1 is a side view, partly in section, of the spray gun.
FIG. 2 is a longitudinal section, at a larger scale, through the forward portion of the spray gun shown in FIG. 1.
FIG. 3 is a fragmentary front view at a still larger scale.

The spray gun shown in the Figures is intended for liquid paint that is dispersed by air jets. It comprises generally an electrically conductive rear portion 11 that forms a grounded handle and a barrel-formed portion 12. The barrel-formed portion 12 comprises a cylindrical housing 13 that is affixed to the handle 11 by means of screws. A cylindrical body 14 is held in the housing by means of a nut 15 and another nut 16 clamps an air nozzle 17 to the cylindrical body 14. The cylindrical housing 13, the nuts 15, 16 and the air nozzle 17 are made of an electrically insulating plastic material.

As shown in FIGS. 2, a paint nozzle 18 is screwed into the cylindrical body 14 and it has a flange 19 that is clamped between a support ring 20 and the air nozzle 17. A plurality of axial holes 21 extend through the flange 19. The paint nozzle 18 has a forward extension 22 that extends through a central hole 23 in the air nozzle 17 with an annular gap 24 thereto. There is a paint discharge orifice 25 in the extension 22 so that the paint nozzle 18 will form an annular forward-directed surface 26 around the discharge orifice. The gap 24 and a plurality of holes 27 in the air nozzle 17 are supplied with air from an annular chamber 28. Another annular chamber 29 supplies air to obliquely inward-directed passages 30 in two horns 31 on the air nozzle 17. An axial and axially slidable rod 32 of electrically insulating plastic material has a coned tip 33 that forms a paint valve with a coned seat 34 formed inside the paint nozzle 18 close to the discharge orifice 25. The interior of the paint nozzle 18 is supplied with paint through an external hose 35, a hose fitting 36, a hose 37 inside the handle 11 and a passage 38 (FIG. 2) through the cylindrical body 14. The rod 32 extends through a packing 39 that prevents leakage.

The paint nozzle 18 is machined from a sintered body that consists of an electrically non-conductive matrix, e.g. polytetrafluoroethylene, with electrically conductive particles, e.g. bronze particles or graphite particles, dispersed therein. Since the annular surface 26 is machined after the sintering, it will show a high number of conductive particles which form electrode points. The rear end of the paint nozzle 18 is connected to an outer source of high voltage through a shielded cable 40, a safety impedance 41 and two screws 42, 43 and the paint nozzle conducts itself the high voltage to its annular electrode forming surface 26. It is not necessary that the conductive particles in the matrix be in direct contact with each other.

Air is suppled through a hose 44 to an inlet chamber 45 in the handle. When a trigger 46 is pulled, it pulls the rod valve 32 backwards against the action of a spring 47 and it also opens an air valve 48 that admits air to a passage 49 that leads to an annular chamber 50 — that, as shown in FIG. 2, communicates with the annular chamber 28 by means of the holes 21 — and to another non-illustrated passage that leads to the annular chamber 29. The air through the circular gap 24 and through the holes 27 disperses the liquid paint into fine particles and the electrode points in the annular surface 26 around the discharge orifice 25 produce air ions that attach to the paint particles. The air through the horns 31 flattens the paint spray. The air to the annular chamber 29 and thereby to the horns 31 can be shut off by a manually controlled valve 51 when a round pattern instead of a flat pattern is desired.

What we claim is:

1. Electrostatic spray gun comprising a paint nozzle with a paint discharge orifice, means to convey paint to the paint nozzle, and means coupling high voltage to the paint nozzle, said nozzle comprising a body consisting essentially of a non-conductive matrix and a large number of electrically conductive particles dispersed therein, said body having an annular surface around the paint discharge orifice which includes a plurality of exposed particle surfaces forming a plurality of electrodes for producing air ions, a plurality of said exposed particle surfaces comprising a substantial portion of the maximum cross-section of the respective particle, the exposed particle surfaces being substantially coplanar with the immediately adjacent surface of said non-conductive matrix.

2. Spray gun according to claim 1, wherein said annular surface is concentric with said discharge orifice.

3. Spray gun according to claim 1 for liquid paint that is dispersed by an air flow, wherein said gun includes an air nozzle of electrically non-conductive material having an opening therein, and wherein said body extends with an annular portion through said opening so as to form an air gap between the air nozzle and said annular portion for dispersing air, a front surface of said annular portion forming said annular surface with said electrodes.

4. Spray gun according to claim 1, wherein said discharge orifice is formed directly in said body.

5. Spray gun according to claim 3, wherein said discharge orifice is formed directly in said body.

6. Spray gun according to claim 1, wherein said body is a sintered body and wherein said surface is a machined surface which is machined after the sintering in order to obtain said electrodes.

7. Spray gun according to claim 6, wherein said sintered body consists of an electrically conductive powder in a matrix of polytetrafluoroethylene.

8. Spray gun according to claim 7, wherein said powder is a bronze powder.

9. Spray gun according to claim 4, wherein said gun includes an axially movable rod that is coaxial with the discharge orifice and wherein said body has an internal seat behind said discharge orifice, said seat forming a valve for the paint together with said axially movable rod.

10. Spray gun according to claim 9 wherein said seat is conical and said rod has a conical portion cooperating with said seat.

11. Spray gun according to claim 9, wherein said rod is electrically non-conductive.

12. Spray gun according to claim 1, wherein said paint discharge orifice is an orifice in said annular surface.

13. Spray gun according to claim 1, wherein said nozzle has an internal seat behind the discharge orifice, said seat forming a valve for the paint together with an axially movable rod that is coaxial with the discharge orifice.

14. Spray gun according to claim 13, wherein said seat is conical and said rod has a conical tip cooperating with said seat.

15. Spray gun according to claim 13, wherein said rod is electrically nonconductive.

16. Spray gun according to claim 1 wherein substantially all of said exposed particle surfaces are spaced from each other.

17. Spray gun according to claim 1 wherein said non-conductive matrix is polytetrafluoroethylene, and wherein said electrically conductive particles are bronze powder particles.

18. Spray gun according to claim 1 wherein said paint is liquid paint.

19. Spray gun according to claim 1 wherein said paint comprises a powder.

20. A nozzle for use in an electrostatic spray gun comprising a body consisting of a non-conductive matrix and a large number of electrically conductive particles dispersed therein, said nozzle having an annular surface around the paint discharge orifice which includes a plurality of exposed particle surfaces forming a plurality of electrodes for producing air ions, a plurality of said exposed particle surfaces comprising a substantial portion of the maximum cross-section of the respective particle, the exposed particle surfaces being substantially coplanar with the immediately adjacent surface of said non-conductive matrix.

* * * * *